US010764664B2

(12) United States Patent
Wu et al.

(10) Patent No.: US 10,764,664 B2
(45) **Date of Patent: *Sep. 1, 2020**

(54) SPEAKER BOX

(71) Applicant: AAC Technologies Pte. Ltd., Singapore (SG)

(72) Inventors: Jun Wu, Shenzhen (CN); Kaihua Shen, Shenzhen (CN); Wang Sun, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,571

(22) Filed: Jul. 30, 2019

(65) Prior Publication Data

US 2020/0045399 A1 Feb. 6, 2020

(30) Foreign Application Priority Data

Aug. 2, 2018 (CN) ..... 2018 1 0871829

(51) Int. Cl.

| | |
|---|---|
| ***H04R 9/02*** | (2006.01) |
| ***H04R 1/28*** | (2006.01) |
| ***H04R 1/02*** | (2006.01) |
| *H04R 9/06* | (2006.01) |

(52) U.S. Cl.

CPC ..... *H04R 1/025* (2013.01); *H04R 1/021* (2013.01); *H04R 1/288* (2013.01); *H04R 9/06* (2013.01); *H04R 2400/11* (2013.01); *H04R 2499/11* (2013.01)

(58) Field of Classification Search

CPC ..... H04R 9/06; H04R 1/288; H04R 1/021; H04R 2400/11; H04R 2499/11; H04R 9/02

USPC ..... 381/332, 386

See application file for complete search history.

(56) References Cited

U.S. PATENT DOCUMENTS 10,433,037 B2 * 10/2019 Li ..... H04R 1/2853

FOREIGN PATENT DOCUMENTS

| | | | | |
|---|---|---|---|---|
| CN | 207070332 | * | 3/2018 | ..... H04R 9/02 |
| CN | 207460510 | * | 6/2018 | ..... H04R 9/06 |

* cited by examiner

*Primary Examiner* — Vivian C Chin
*Assistant Examiner* — Ubachukwu A Odunukwe
(74) *Attorney, Agent, or Firm* — W&G Law Group LLP

(57) ABSTRACT

The present disclosure provides a speaker box which comprises a shell, a speaker, a support wall, and a sound guide channel. The speaker is fixed to be supported on the support wall. The diaphragm of the speaker partitions the receiving space into a front sound cavity and a rear cavity. The sound guide channel communicates the front sound cavity with the outside and forms the front cavity with the front sound cavity. The speaker box also comprises a surrounding wall and a cover plate arranged on the surrounding wall. The surrounding wall is located on the outside of the support wall, and the shell, surrounding wall, support wall and cover plate are jointly enclosed as auxiliary acoustic cavity. Compared with the related art, the high frequency acoustic performance of the speaker box of the present disclosure is excellent.

7 Claims, 4 Drawing Sheets

SPEAKER BOX

FIELD OF THE DISCLOSURE

The present disclosure relates to acoustic-electro transducers, and more particularly to a speaker box used in a portable electronic device.

DESCRIPTION OF RELATED ART

With the arrival of the mobile internet era, the number of smart mobile devices is being increasing. However, in all these mobile devices, mobile phones are the most common and portable mobile terminal deices. At present, mobile phones are powerful functionality, and one of the powerful functions is the high-quality music function. Therefore, speaker boxes for playing music are widely applied to conventional smart mobile devices.

A speaker box of the related art comprises a shell having a receiving space, a speaker accommodated in the shell and a sound guiding channel defined in the receiving space. The speaker comprises a diaphragm for producing sound by vibrating, the diaphragm partitions the receiving space into a front sound cavity and a rear cavity. The sound guiding channel communicates the front sound cavity with the outside, and cooperatively defines a front cavity with the front sound cavity.

However, in the speaker box of the related art, the space of the front cavity is limited to a region rightly opposite to a dome and a region of the sound guiding channel, and the structure is monotonous and may not be optimized. Therefore, high-frequency acoustic performance of the speaker box is subject to restrictions, and over-high high-frequency responses may cause harsh sounds, sharp dentilabial sounds and the like poor sound effects.

Therefore, it is desired to provide a speaker box to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
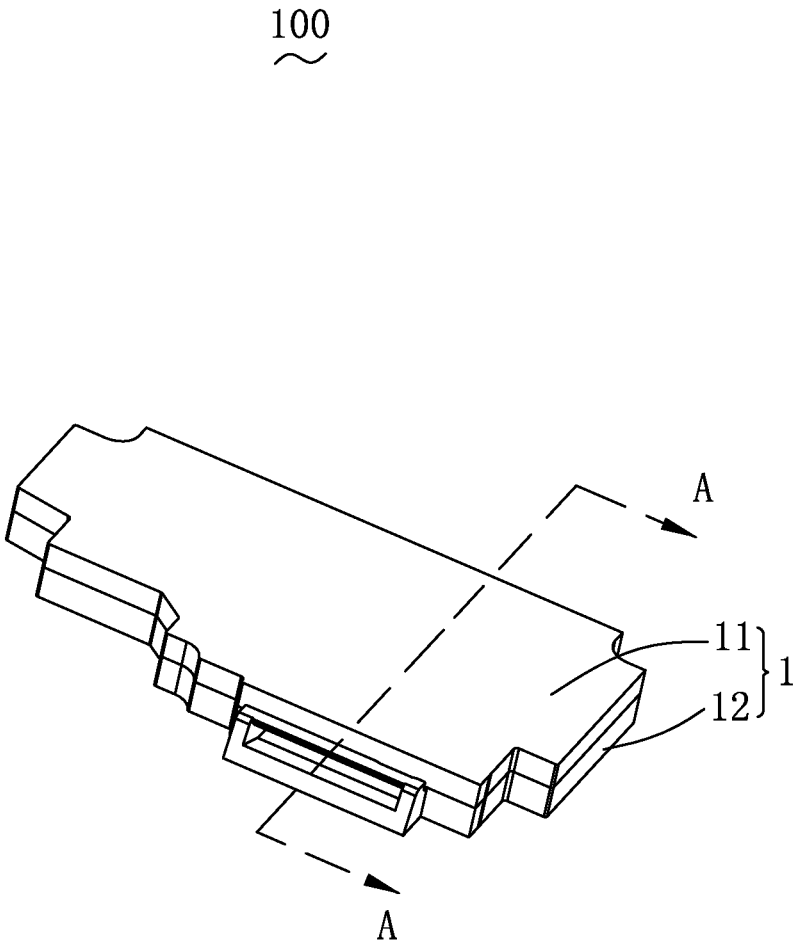
FIG. 1 is a schematic diagram of a three-dimensional structure of the speaker box in accordance with an exemplary embodiment of the present disclosure.
Figure 2:
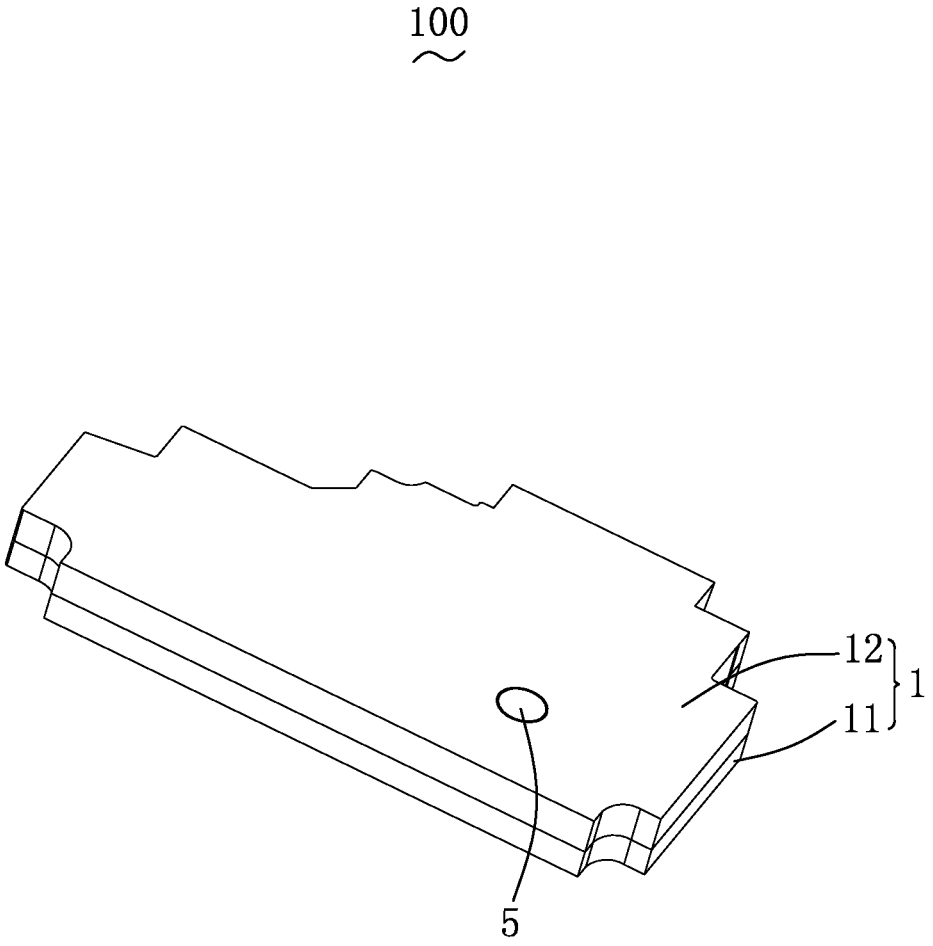
FIG. 2 is a schematic diagram of the structure of the speaker box showing another perspective view in FIG. 1.
Figure 3:
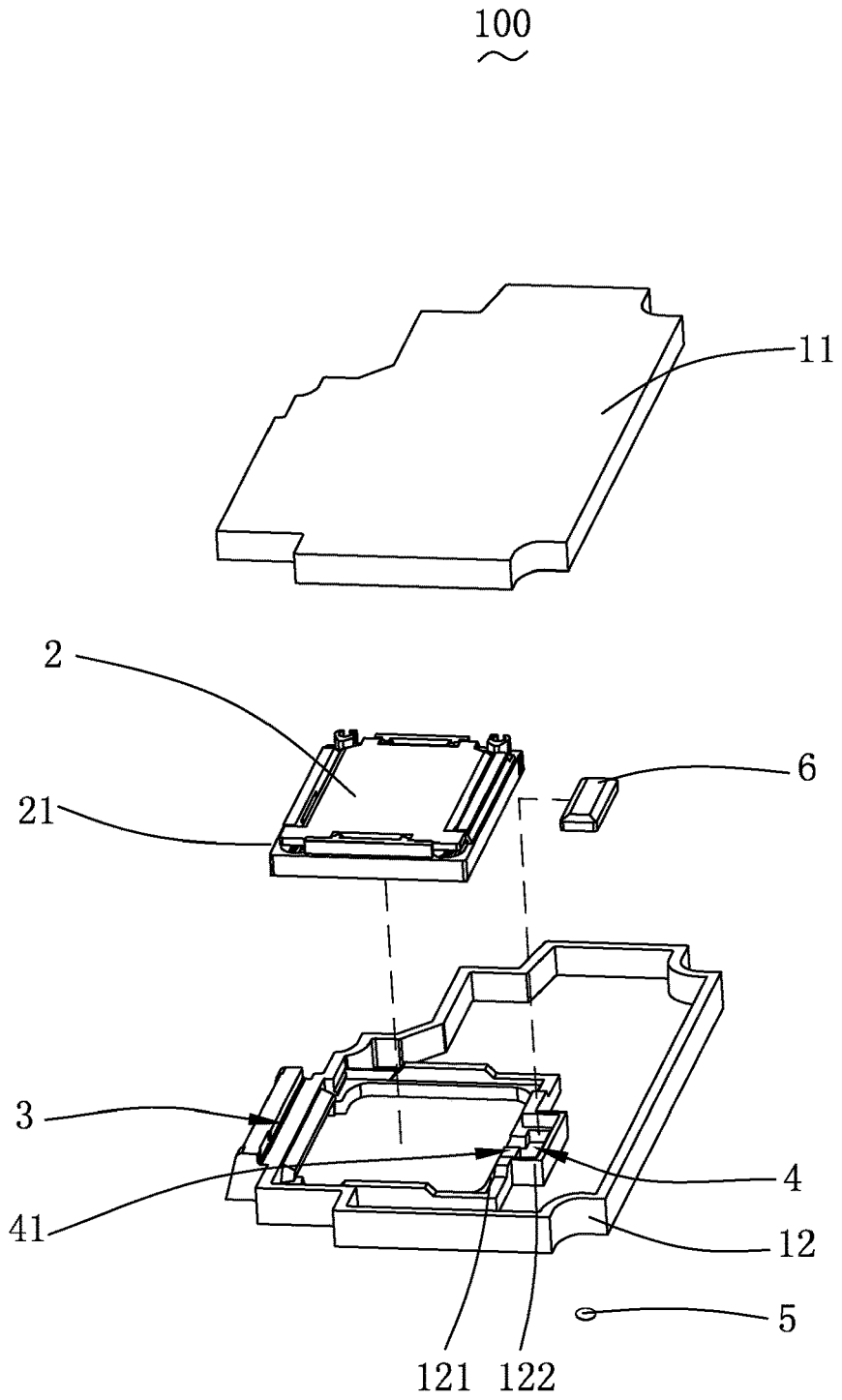
FIG. 3 is a schematic diagram of the three-dimensional structure of the speaker box exploded view showing in FIG. 1.
Figure 4:
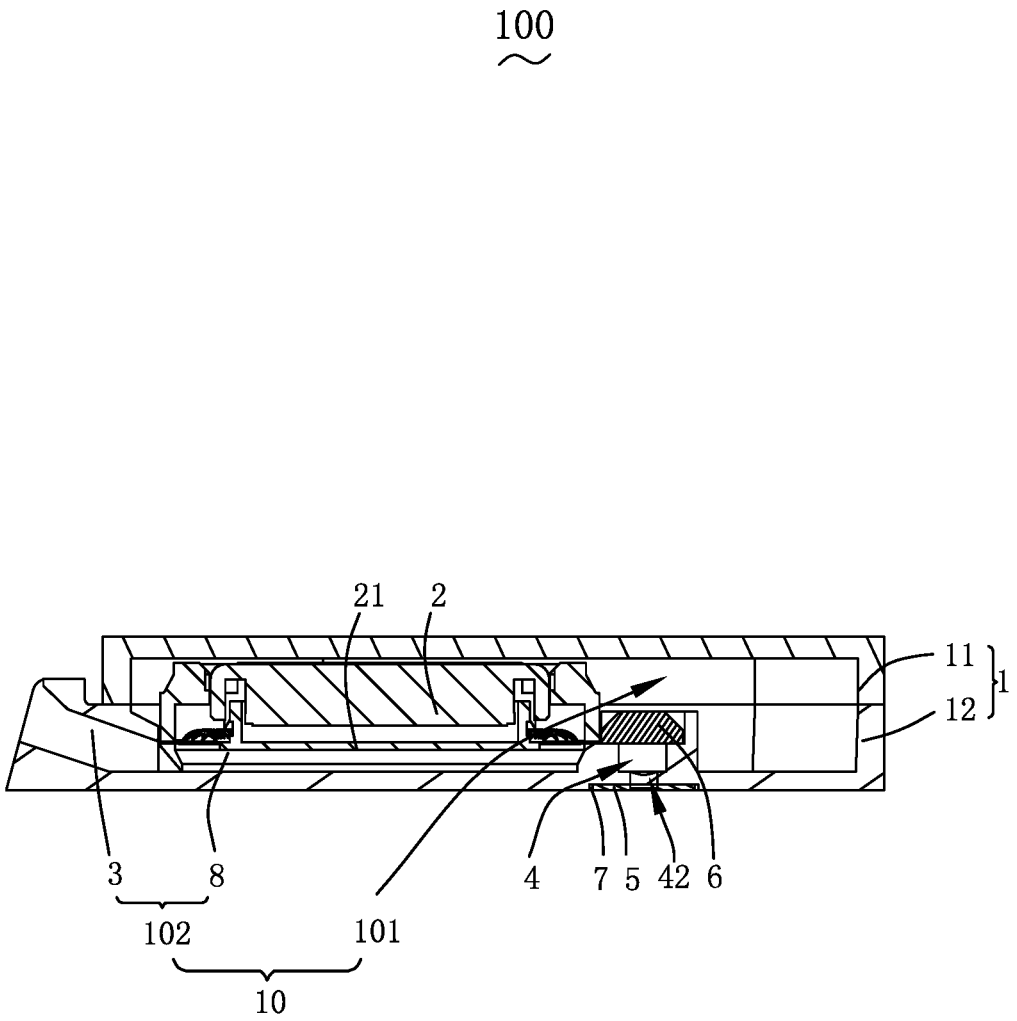
FIG. 4 is a cross-sectional view along the A-A line showing in FIG. 1.

Please also refer to FIG. 1 to FIG. 4, wherein FIG. 1 is a three-dimensional structure diagram of the speaker box of the present disclosure, FIG. 2 is another perspective view schematic of the speaker box showing in FIG. 1, FIG. 3 is a schematic exploded view of the three-dimensional structure of a speaker box showing in FIG. 1, FIG. 4 is a cross-sectional view taken along line A-A of FIG. 1.

The present disclosure provides a speaker box 100, which comprises a shell 1, a speaker 2, a sound guiding channel 3, an auxiliary acoustic cavity 4, a damping mesh 5, a cover plate 6 and a groove 7.

The shell 1 may be formed integrally or be formed separately. For example, in this embodiment, the housing 1 includes a lower cover 11, and an upper cover 12 covering with the lower cover 11 and cooperatively defining the receiving space 10 with the lower cover 11.

The speaker 2 is accommodated in the receiving space 10 of the Shell 1, and the speaker 2 partitions the receiving space 10 into a front sound cavity 8 and a rear cavity 101.

The shell 1 comprises a support wall 121 and a surrounding wall 122. The support wall 121 and the surrounding wall 122 are formed in the upper cover 12. The speaker 2 is supported by the support wall 121 and cooperates with the upper cover 12 to form the front sound cavity 8.

In this embodiment, the speaker 2 comprises a diaphragm 21 for vibration and produce sound via irradiation, and the diaphragm 21 partitions the receiving space 10 into the front sound cavity 8 and the rear cavity 101. In particular, the diaphragm 21 is set at intervals with the upper cover 12, and cooperates with the upper cover 12 to form the front sound cavity 8. The diaphragm 21, the lower cover 11 and the upper cover 12 cooperatively define the rear cavity 101. The rear cavity 101 is used to improve the low frequency acoustic performance of the speaker box 100.

The support wall 121 is for supporting and fixing the speaker 2. The support wall 121 is formed by the inner extension of the shell 1. The surrounding wall 122 is located on the outside of the support wall 121, and the surrounding wall 122 is formed by the inner extension of the shell 1.

In particular, the Shell 1, the surrounding wall 122, the support wall 121 and the cover plate 6 are jointly enclosed as the auxiliary acoustic cavity 4.

In this embodiment, a through-hole 41 is disposed through the support wall 121, the auxiliary acoustic cavity 4 is communicated with the front cavity 102 through the through-hole 41 to form the resonator structure of the front cavity 102, and the sound guiding channel 3 is formed in the receiving space 10 of the shell 1.

The sound guiding channel 3 is formed in the upper cover 12. The sound guiding channel 3 communicates the front sound cavity 8 with the outside, and the sound guiding channel 3 is cooperates together with the front sound cavity 8 to form the front cavity 102. The sound guiding channel 3 is used to form a side sound radiating structure of the front cavity 102.

The auxiliary acoustic cavity 4 communicates with the front cavity 102 through the through-hole 41. The speaker box 100 further includes a leakage structure, the leakage structure includes a leakage hole 42 through the shell 1 and a damping mesh 5 arranged in the leakage hole 42, the damping mesh 5 is located on the outside of the auxiliary acoustic cavity 4. The damping adjustment is realized by adjusting the number of holes of the damping mesh 5 for balancing and improving the sound pressure of the auxiliary acoustic cavity 4 and the outside.

In the present embodiment, the speaker 2 isolates the front cavity 102 from the auxiliary acoustic cavity 4 into two cavities, and allows the auxiliary acoustic cavity 4 to be communicated with the front cavity 102 through the through-hole 41, that is, the auxiliary acoustic cavity 4 severs as a part of the front cavity 102, and the auxiliary acoustic cavity 4 is used as a resonant cavity of the front cavity 102. On the one hand, the aforementioned structure effectively increases the volume of the cavity of the front cavity 102 and improves the high-frequency acoustic performance, on the other hand, the aforementioned structure design of the auxiliary acoustic cavity 4 is more flexible and diverse, and the restriction is small and the applicability is higher.

Specifically, the auxiliary acoustic cavity 4 is communicated with the front sound cavity 8 through the through-hole 41. Of course, the auxiliary acoustic cavity 4 can also be communicated with the sound guiding channel 3 through the through-hole 41, which is also possible, and the principle is the same.

The speaker 2 is fixed to the support wall 121 by glue bonding, the method makes the whole structure of the acoustic monomer 2 combined with the support wall 121 stronger.

The cover plate 6 covers the surrounding wall 122, the shell 1 cooperates with the surrounding wall 122, the support wall 121 and cover plate 6 to form the auxiliary acoustic cavity 4, so that the auxiliary acoustic cavity 4 forms a sealed cavity structure for charging the cavity of the front cavity 102 to realize high-frequency acoustic performance adjustment of the front cavity 102. The cover plate 6 is made of a PET, the PET material has higher impact strength and folding resistance than the related materials, and the sanitary safety is better. The structure of the auxiliary acoustic cavity 4 can effectively reduce the Q value of the high frequency resonance peak of the speaker box (quality factor value) and sensitivity make the acoustic performance of the speaker box 100 better.

In the present embodiment, the upper cover 12 is provided with a groove 7 which is recessed in the direction of the lower cover 11 and communicates with the leakage hole 42. The damping mesh 5 is received in the groove 7. It makes the damper mesh 5 less to be scratched and peeled off.

Compared with the relevant art, the speaker box 100 of the present invention forms an auxiliary acoustic cavity 4 connecting with the front cavity 102 in the shell 11, so that the auxiliary acoustic cavity 4 performs as a part of the front cavity 102 and acts as a resonant cavity, on the one hand, the aforementioned structure effectively increases the volume of the cavity of the front cavity, and improves High-frequency acoustic performance, on the other hand, the auxiliary acoustic cavity structure design is more flexible and diverse, and the applicability is higher. The above structure can effectively reduce the Q value (quality factor value) and sensitivity of the high-frequency resonance peak of the speaker box, so that the acoustic performance of the speaker box better.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a shell having a receiving space;

a support wall, which is formed by extending the inner side of the shell;

a speaker, which is accommodated in the receiving space of the shell and fixed on the support wall, wherein the speaker comprises a diaphragm for producing sound via vibrating, which partitions the receiving space into a front sound cavity and a rear cavity;

a sound guiding channel, which is formed in the receiving space and communicates the front sound cavity with the outside and cooperatively defines an front cavity with the front sound cavity;

a surrounding wall, which is formed by extending from one inner side of the shell and is located outside the support wall;

a cover plate, which covers the surrounding wall, and the shell, the surrounding wall, the support wall and the cover plate are cooperatively enclosed as an auxiliary acoustic cavity; wherein the support wall comprises a through-hole, and the auxiliary acoustic cavity communicates with the front cavity through the through-hole to form a resonant cavity structure of the front cavity;

a leakage structure for balancing the auxiliary acoustic cavity with external sound pressure, which includes a leakage hole penetrating therethrough the shell and a damping mesh covering the leakage hole.

2. The speaker box as described in claim 1, wherein damping mesh is located outside the auxiliary acoustic cavity.

3. The speaker box as described in claim 1, wherein the auxiliary acoustic cavity is communicated with the front sound cavity through the through-hole.

4. The speaker box as described in claim 1, wherein the shell comprises an upper cover and a lower cover forming a receiving space with the upper cover, the support wall and the surrounding wall are formed on the upper cover, and the speaker is supported on the support wall and cooperatively defines the front sound cavity with the upper cover.

5. The speaker box as described in claim 1, wherein the speaker box is fixed to the support wall by glue bonding.

6. The speaker box as described in claim 1, wherein the cover plate is made of PET material.

7. The speaker box as described in claim 1, wherein the outer surface of the shell is recessed to form groove communicating with the leakage hole, and the damping mesh is positioned in the groove.

* * * * *